United States Patent [19]

Lichtblau

[11] Patent Number: 4,667,635

[45] Date of Patent: May 26, 1987

[54] HELICAL SPRING FORMING COOLING CHANNEL AROUND LIQUID-COOLED CYLINDER

[75] Inventor: Leo Lichtblau, Cologne, Fed. Rep. of Germany

[73] Assignee: Köckner-Humboldt-Deutz AG, Cologne, Fed. Rep. of Germany

[21] Appl. No.: 800,404

[22] Filed: Nov. 21, 1985

[30] Foreign Application Priority Data

Nov. 23, 1984 [DE] Fed. Rep. of Germany ..... 3442676

[51] Int. Cl.[4] ..... F01P 3/02

[52] U.S. Cl. ..... 123/41.8; 123/41.84

[58] Field of Search ..... 123/41.8, 41.83, 41.84

[56] References Cited

U.S. PATENT DOCUMENTS 2,151,698 3/1939 Harper, Jr. ..... 123/41.8

3,672,263 6/1972 Mirjanic ..... 123/41.8

FOREIGN PATENT DOCUMENTS 601894 5/1948 United Kingdom ..... 123/41.8

*Primary Examiner*—William A. Cuchlinski, Jr.

*Attorney, Agent, or Firm*—Watson, Cole, Grindle & Watson

[57] ABSTRACT

The helical cooling channel in the cooling gap between the cylinder pipe and the associated cylindrical part of the housing and internal combustion engine is formed by a helical spring which is fixed in the cooling gap under radial tension. The helical spring rests against either the cylindrical part of the housing of the internal combustion engine or the cylinder pipe.

6 Claims, 2 Drawing Figures

HELICAL SPRING FORMING COOLING CHANNEL AROUND LIQUID-COOLED CYLINDER

BACKGROUND OF THE INVENTION

1. Field of the Invention

This invention concerns a liquid-cooled cylinder pipe of an internal combustion engine, especially a diesel engine.

2. The Prior Art

It is known from German Published Application No. DE-OS 28 25 870 to provide a helical dividing wall on the side of the housing of the internal combustion engine facing the cylinder pipe, which essentially extends to the cylinder pipe. In this manner, a helical cooling channel surrounding the cylinder pipe is formed, which assures a high degree of heat discharge from the cylinder pipe. However, the construction of the dividing wall in the cooling gap between the housing and the cylinder pipe is difficult to manufacture and thus expensive.

The object of the present invention is to provide a helical cooling agent pathway around the cylinder pipe of an internal combustion engine which is inexpensive to construct and which uses simple means.

SUMMARY OF THE INVENTION

According to the present invention a helical spring is inserted into the cooling gap between the housing and the cylinder pipe, such that it sits firmly in the cooling gap by radial tension, thus forming a helical cooling channel. Such a helical spring can be inserted into any internal combustion engine, whereby the slope of the windings as well as the number of windings of the helical spring can easily be adapted to the respective cooling requirement. The helical spring is constructed according to the desired heat transfer value.

The helical spring for the most part rests tightly against one wall of the cooling gap and at a slight distance from the other wall. In this manner it is assured that, apart from the helical flow, it is also possible to obtain a partial axial flow along the cylinder, which provides for an additional increase in the heat transfer value.

Preferably, the outer diameter of the helical spring is larger than the inside diameter of the location hole in the housing, so that the helical spring rests under radial tension against the housing wall. As the helical spring also has a gap towards the cylinder pipe, the cylinder pipe can be inserted without obstruction after the helical spring is installed.

The cross section of the helical spring wire is preferably rectangular, particularly square, whereby one lateral wall of the cross section sits against one wall of the cooling gap, thus providing for a relatively large contact surface.

Further features and advantages of the invention will become apparent by reference to the attached drawings taken in conjunction with the following discussion.

DETAILED DESCRIPTION OF THE PREFERRED EMBODIMENTS

Figure 1:
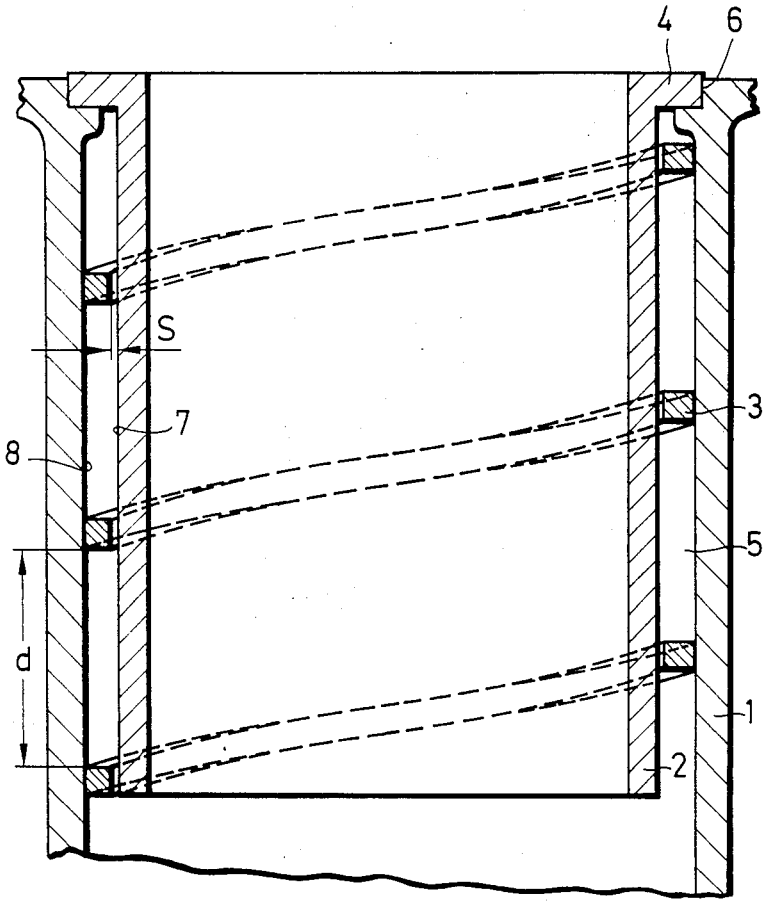
FIG. 1 shows a cross sectional view of a part of the housing of an internal combustion engine and the associated cylinder pipe, the cooling gap therebetween containing a helical spring according to one embodiment of the present invention for providing a helical cooling channel.
Figure 2:
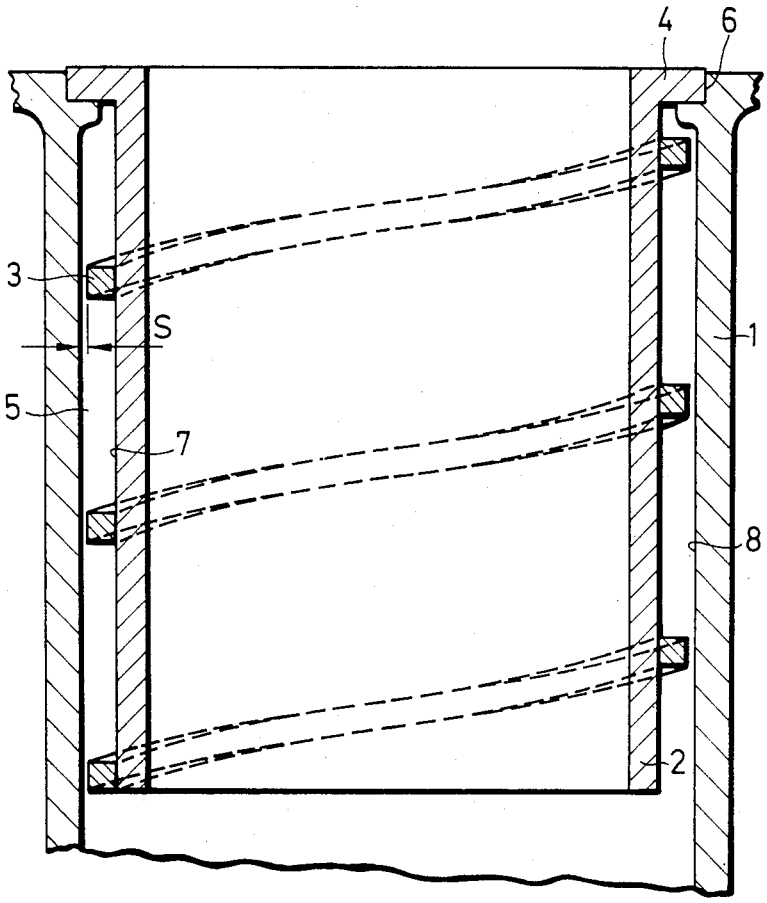
FIG. 2 shows a similar cross sectional view, the cooling gap containing a helical spring according to another embodiment of the present invention.

In FIGS. 1 and 2 only the cylindrical part of the housing 1 of the internal combustion engine which holds the cylinder pipe 2 is shown. This cylindrical housing part has, at its upper edge, a surrounding indentation 6 to accept a ring flange 4 of the cylinder pipe 2, pointing radially towards the outside. The flange 4 has a radial extension in such a manner that a cooling gap 5 is formed between the cylindrical inside wall 8 of the housing 1 and the cylindrical outside wall 7 of the cylinder pipe 2.

A helical spring 3 is inserted into the cooling gap 5, the spring wire of which has a rectangular cross section, preferably square as shown in the embodiment. In FIG. 1 the helical spring 3 rests, under radial tension, with its windings mostly tightly against the cylindrical inside wall 8 of the housing 1. In this manner the sides of the cross section are arranged parallel or at right angle to the side wall 8. Towards the cylindrical outside wall of the cylinder pipe, the inside surface of the helical spring or its winding have a gap s, which provides for a partial axial flow along the cylinder pipe. This partial axial flow accumulates next to the helical flow in the cooling channel between the individual windings of the helical spring 3, which have a distance d between each other, that determines the height of the cooling channel. The convection, forced in this manner, provides for the increase heat transfer from the cylinder pipe to the cooling agent flowing through. This increase in heat transfer is particularly advantageous in cooling liquids which have a lower heat transfer property than water.

The embodiment according to FIG. 2 agrees with the one according to FIG. 1 in its basic construction, whereby the same reference numbers are used. The helical spring inserted in FIG. 2 rests against the cylinder pipe 2 under radial tension and has a distance (s) from the cylindrical inside wall 8 of the housing 1.

In the embodiment according to FIG. 1, the helical spring in the unstressed state has an outside diameter which is larger than the inside diameter of the cylindrical wall 8 of the housing part 1. In the embodiment according to FIG. 2, the inside diameter of the helical spring in the unstressed state is smaller than the outside diameter of the cylinder pipe 2.

It may be suitable to variably design the distance d of adjoining windings of the helical spring 3. Thus, it would be possible, e.g., to have a smaller distance d in the upper area of the cylinder pipe (in the area of the combustion chamber) than in the lower area. This is the progression, e.g., of a helical spring with progressive slope. Through this construction, the higher incident of heat from the combustion chamber is taken into account. It thus provides for a stronger heat discharge at the end of the cylinder pipe 2 facing towards the combustion chamber.

I claim:

1. In an internal combustion engine which includes a housing part having an inner surface which defines a cylindrical channel that leads to a combustion chamber, and a cylindrical pipe positioned within said housing part, said cylindrical pipe having an outer surface whose radius is less than the radius of said inner surface of said housing part so as to provide an annular cooling gap therebetween, the annular cooling gap having an upper end adjacent the combustion chamber and a lower end, the improvement wherein a helical spring is located in said annular cooling gap, said helical spring having a first end in the upper end of said annular gap and a second end in the lower end of said annular gap and being composed of individual windings, said windings being spaced apart a lesser distance at the first end of said helical spring than at the second end thereof, the diameter of said helical spring and the thickness of the individual windings thereof being such that the windings contact the inner surface of said housing part and leave a space between them and said outer surface of said cylindrical pipe.

2. An internal combustion engine according to claim 1, wherein said helical spring is made of wire which has a rectangular cross section.

3. An internal combustion engine according to claim 1, wherein said helical spring abuts under radial pressure against the inner surface of said housing part.

4. In an internal combustion engine which includes a housing part having an inner surface which defines a cylindrical channel that leads to a combustion chamber, and a cylindrical pipe positioned within said housing part, said cylindrical pipe having an outer surface whose radius is less than the radius of said inner surface of said housing part so as to provide an annular cooling gap therebetween, the annular cooling gap having an upper end adjacent the combustion chamber and a lower end, the improvement wherein a helical spring is located in said annular cooling gap, said helical spring having a first end in the upper end of said annular gap and a second end in the lower end of said annular gap and being composed of individual windings, said windings being spaced apart a lesser distance at the first end of said helical spring than at the second end thereof, the diameter of said helical spring and the thickness of the individual windings thereof being such that the windings contact the outer surface of said cylindrical pipe and leave a space between them and said inner surface of said housing part.

5. An internal combustion engine according to claim 4, wherein said helical spring is made of wire which has a rectangular cross section.

6. An internal combustion engine according to claim 4, wherein said helical spring abuts under radial pressure against the outer surface of said cylindrical pipe.

* * * * *